United States Patent [19]

Macosko

[11] 4,104,110

[45] Aug. 1, 1978

[54] HAND HELD APPLICATOR

[76] Inventor: Robert Lee Macosko, 9701 Nita Ave., Chatsworth, Calif. 91311

[21] Appl. No.: 804,063

[22] Filed: Jun. 6, 1977

[51] Int. Cl.[2] ..... B32B 31/00; B44C 7/06

[52] U.S. Cl. ..... 156/523; 156/576; 156/577

[58] Field of Search ..... 156/523, 576, 577

[56] References Cited

U.S. PATENT DOCUMENTS

| | | | |
|---|---|---|---|
| 2,500,157 | 3/1950 | Deutsch | 156/523 |
| 3,540,969 | 11/1970 | Jorgensen | 156/523 |
| 3,582,438 | 6/1971 | Harbour | 156/523 |
| 3,813,274 | 5/1974 | Rothenberger | 156/576 |
| 3,990,933 | 11/1976 | Verch | 156/576 |

*Primary Examiner*—Douglas J. Drummond

*Attorney, Agent, or Firm*—Paul H. Ware

[57] ABSTRACT

A hand held tape applicator operable with one hand for holding and applying pressure sensitive adhesive tape to a receiving surface from a roll of tape and for severing the roll of tape from the tape applied. In operation, the tape is pressed against the receiving surface by a tape-applying roller until a desired length of tape is unrolled and applied to the surface. After the desired length of tape has been applied to the receiving surface, a thumb actuated slide button actuates a serrated cutting edge so as to cut the tape. If desired, the tape applicator can be operated in the conventional manner of stripping off a length of tape to be applied to a receiving surface by the use of both hands holding both ends of the tape strip as obtained from the roll.

2 Claims, 8 Drawing Figures

Fig. 4a.
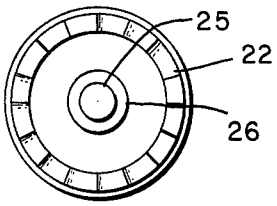
Fig. 5.
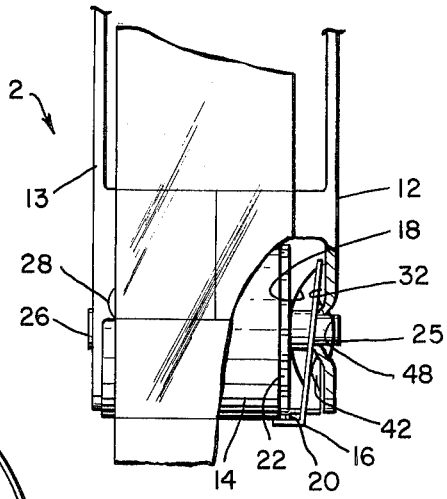
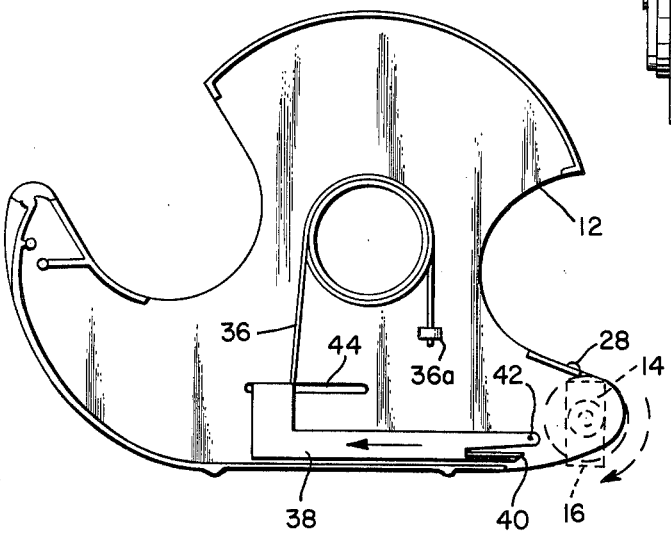
Fig. 6.
Fig. 7.
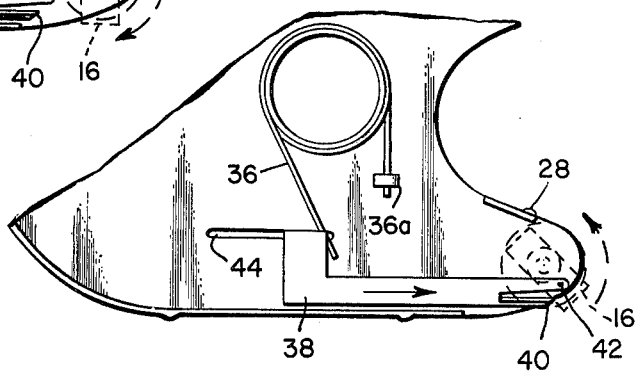
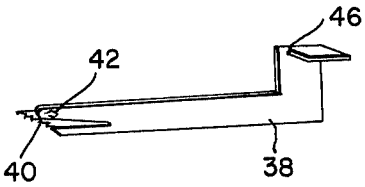
Fig. 8.

HAND HELD APPLICATOR

BACKGROUND OF THE INVENTION

1. Field of the Invention

This invention relates to hand held tape applicators and more particularly to a new and improved tape dispenser for applying selected lengths of pressure sensitive adhesive tape onto a surface in such a manner that it is not necessary for the operator to handle the tape during repeated applications.

2. Description of the Prior Art

There are many different tape dispensing devices in the prior art, however, most require operator manipulation to effectively apply the tape without having to seek out the end of the tape after a preceding application. Some of these prior art devices have been described in the following listed patents that were brought to the attention of the Applicant through a novelty search conducted in the United States Patent and Trademark Office 1. Title: TAPE APPLICATOR; U.S. Pat. No. 3,850,779; Patentee: Walter C. Pearson.
2. Title: TAPE DISPENSER; U.S. Pat. No. 3,725,182; Patentee: James L. Regan.
3. Title: SINGLE HANDED TAPE DISPENSER; U.S. Pat. No. 3,539,418; Patentee: John V. Combs.
4. Title: TAPE APPLICATOR HAVING NON-STICK SURFACE; U.S. Pat. No. 3,542,628; Patentee: John F. Fink.
5. Title: CONSTRUCTION OF HAND-OPERATED TAPE DISPENSERS; U.S. Pat. No. 3,186,892; Patentee: Kenneth S. Walthers.
6. Title: TAPE APPLICATOR; U.S. Pat. No. 2,732,964; Patentee: Charles A. Neer.
7. Title: TACKING FOR PRESSURE SENSITIVE ADHESIVE TAPE AND ADHESIVE ROLL FOR THE SAME; U.S. Pat. No. 2,634,877; Patentee: Irving Kaplan.
8. Title: TAPE APPLIER AND DISPENSER; U.S. Pat. No. 2,527,588; Patentee: Stanley E. Sorenson.

The shortcomings of some of these dispensers resides in the necessary operator manipulations. For the most part, these known tape dispensing devices comprise a roll support and cutting edge. These devices require that the tape be manually pulled from the roll and severed by movement against a serrated cutting edge. Usually the tape, after being pulled from the roll, is subsequently moved against the cutting element to sever the dispensed portion from the remainder of the roll. However, devices of this type do not enable application of the tape as it is being dispensed from the tape device. In many of these prior art devices, it is necessary to guess the desired length of tape prior to cutting and frequently the user's estimate is in error. Many of these prior known dispensers are inherently complicated, thus costly, prone to malfunction and completely unsatisfactory.

It would thus be a great advantage to the art to provide a hand-held tape dispenser, operable with one hand, that would dispense a length of tape as required by the operator without his having to pre-estimate the length of tape required.

Another great advantage to the art would result from the provision of a tape applicator in which it was unnecessary for the user to handle the tape itself.

A further desirable advantage would be to provide such a mechanism in a relatively inexpensive package.

SUMMARY OF THE INVENTION

It is an object of this invention to provide a new and improved tape dispenser.

A further object of the present invention is to provide a tape dispenser operable with one hand.

A still further object of this invention is to provide a tape dispenser in which the operator will not have to handle the tape for application.

Still another object of the invention is to provide the above objects in a convenient-to-use and economical package.

In the accomplishment of these and other objects, a tape dispenser is provided having the conventional means of dispensing tape in addition to the improvements of the invention. When it is desired to apply the tape in accordance with the advantages of the invention, the tape is manually rolled backwards in the case and pulled over a roller, being sure the tape is aligned between aligning means supplied on the case. The tape to be applied is now advanced over and under the roller and pulled toward the bottom of the dispenser. Now manually sliding a button toward the roller will cause engagement of a tape clamp thus holding the tape to be applied to the roller for application to a receiving surface. Upon releasing the button, the slide arm returns to normal and the device is ready for application of tape. As the tape is being applied to the receiving surface and the tape is beginning to be payed out, the clamp now rotates in conjunction with the roller. As this rotation is accomplished, the tape clamp becomes released from the tape and the roller by the action of a cam inside the housing shell at approximately 45° of roller rotation. A spring inside the housing shell returns the tape clamp to its normal position and once again it is held in place. As the device is rolled forward, it disengages the clamp again at approximately one-half of the roller rotation and a cam inside the housing shell releases the clamp again and the tape can be payed out normally. When a desired length of tape has been applied to the receiving surface, the slide button is advanced forward toward the roller again and this projects a slide arm and a tape engaging lobe engages the tape clamp, forcing a rocker snap spring to snap the clamp back over to the tape and to hold the tape to be rolled again. As this slide arm is advanced further, a serrated cutting edge on the slide cuts the tape. Upon releasing the button the slide arm returns to normal and the device is ready for its next application of tape in the manner of the invention.

BRIEF DESCRIPTION OF THE DRAWINGS

Further advantages and features of the present invention will be more fully apparent to those skilled in the art to which the invention pertains from the ensuing detailed description thereof regarded in conjunction with the accompanying drawings wherein like reference characters refer to like parts throughout and in which:

FIG. 4*a* is a detailed drawing of a star gear as contemplated for use in the invention.

FIG. 5 is a fragmentary frontal elevational view of the device in a different operating position from that shown in FIG. 4 again showing details of the construction of the tape dispenser.

FIG. 6 is an inside view of the left side cover showing detail of the engaging and cutting slide arm in the dispensing position.

FIG. 7 is a fragmentary inside view of the left side cover showing detail of the engaging and cutting slide arm in the tape release and cutting position.

FIG. 8 is a detail drawing showing the slide arm, the tape clamp engaging lobe and the serrated cutting edge.

DETAILED DESCRIPTION

Although specific embodiment of the invention will now be described with reference to the drawings, it should be understood that such embodiments are by way of example only and merely illustrative of but a small number of the many possible specific embodiments which can represent applications of the principles of the invention. Various changes and modifications, obvious to one skilled in the art to which the invention pertains, are deemed to be within the spirit, scope and contemplation of the invention as further defined in the appended claims.

Figure 1:
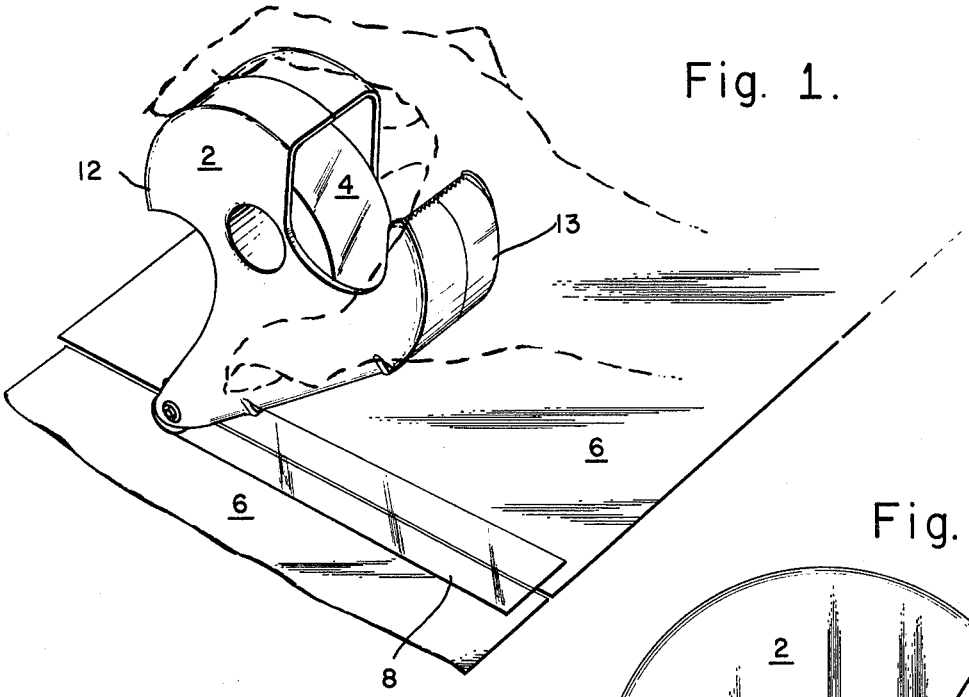
FIG. 1 is a perspective drawing showing the invention in operation.

Referring to FIG. 1 with greater particularity, the tape dispenser is denoted generally by the numeral 2. A tape roll 4, inside the tape case left side, denoted by the numeral 12 and right side denoted by the numeral 13, is shown being applied to a work piece, in this instance, a paper to be mended 6, showing the applied tape as numeral 8. After preparation for application in this manner, the operator has merely to move the device, pressing it on the work piece in the direction shown, to cause the tape to be applied thereto.

Figure 2:
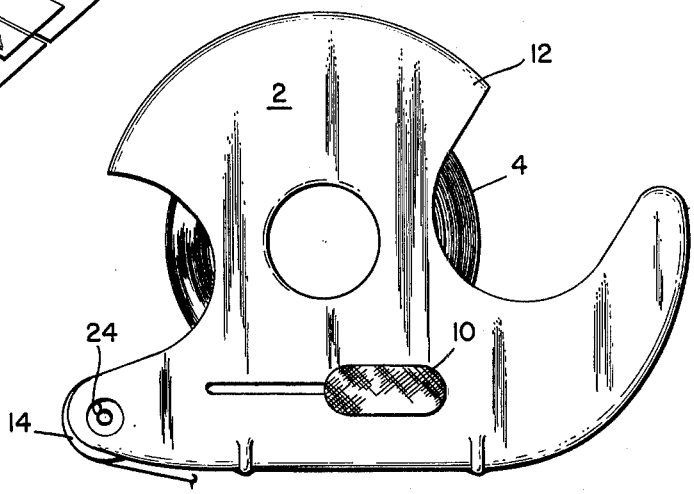
FIG. 2 is a side elevation showing the thumb actuated slide button on the side.

Referring now to the left side elevation, FIG. 2, the device is shown in additional detail. Again the dispenser is generally denoted by the numeral 2 and the case left side denoted by the numeral 12 while 4 denotes the roll of tape. Numeral 10 denotes a thumb slide button as will be used in cooperation with a roller 14 in order to cause operation of the device. This elevation shows also a recess 24 to retain the roller shaft.

Figure 3:
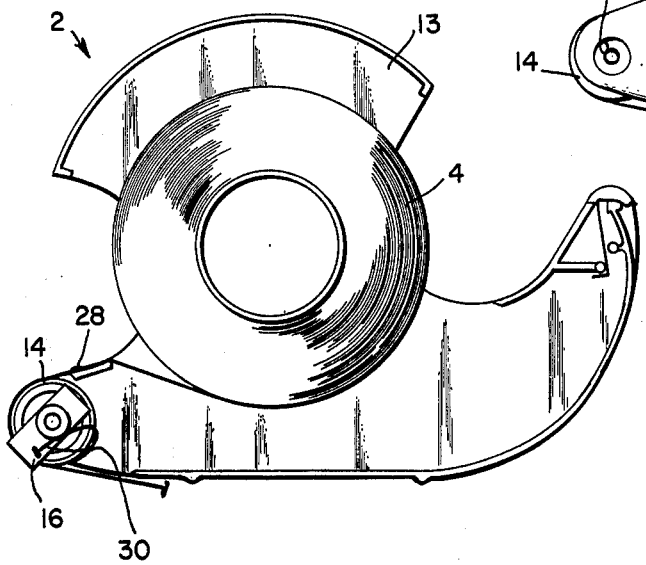
FIG. 3 is a side elevation with half cover removed to show the interior of the tape housing shell.

Referring to FIG. 3, the left side elevation with half cover removed to show the working parts of the device permits of a general exposition. Again the dispenser generally is denoted by the numeral 2. The numeral 13 shows the case right side while the numeral 4 denotes the roll of tape situate in the device. Aligning buttons 28 show the tape as positioned in accordance with their guidance and over the roller 14, around tape clamp 16 with tape clamp return spring 30 in one position.

Figure 4:
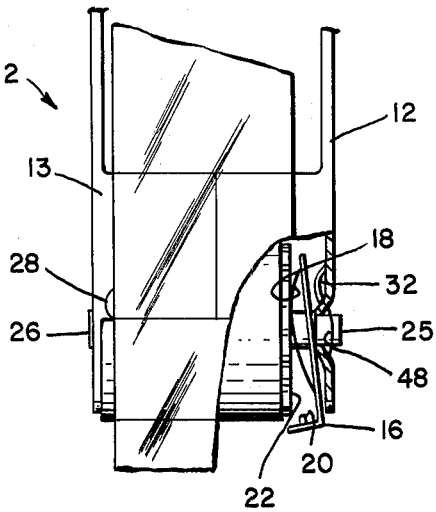
FIG. 4 is a fragmentary frontal elevational view of the device in one operating position showing details of the construction of the tape dispenser.

Referring not to FIG. 4, a partial front elevational view of the device in one operating position is shown. Again the dispenser is denoted generally by the numeral 2 and right and left sides of the case by the numerals 13 and 12 respectively. One of the aligning buttons 28 is shown to the left side of the drawing and the roller shaft 26. The tape itself is shown as cut away so as to expose the working parts of the device. Numeral 18 denotes a rocker snap spring operable to induce the tape clamp 16 to engage and disengage. Numeral 32 denotes a cam utilized for forcing the rocker snap spring 18 into engagement and disengagement. Numeral 25 denotes a shaft offset, stepped from the larger diameter dimension of shaft 26 to make a smaller shaft so as to retain tape clamp 16 and other mechanism. The numeral 48 denotes a roller retaining spring nut in place so as to secure the roller to the shaft. Numeral 22 denotes a star gear that turns in conjunction with the roller while numeral 20 denotes a tooth on tape clamp 16 that will mesh with the star gear 22 and cause the tape clamp to move with a generally forward and upward movement.

FIG. 4*a* shows details of the star gear 22 of FIG. 4. Here, the stepping of the shaft 25 from the larger shaft 26 may be more easily understood and the slots into which the tooth 20 of FIG. 4 fits into the star gear 22 may be more easily seen.

FIG. 5 shows a fragmentary partial front elevational view of the device in a second operating position, that is, with the tooth 20 of FIG. 4 engaged in the star gear 22. Again numerals 13 and 12 denote case right side and left side respectively, 26 denotes the roller shaft, 14 the roller and 32 the cam for tape clamp disengagement. It will be noted that tooth 20 on the tape clamp 16 has been forced to engage with star gear 22 by means of the cam for tape clamp engagement 42 acting with rocker snap spring 18. Cam 42 for the tape clamp 16 is also shown in FIG. 8 and FIG. 7. Actuation of this cam forces the tape clamp 16 into the engaged position shown. A rocker snap spring 18 retains tape clamp 16 in the engaged position.

Referring now to FIG. 6 there is shown an inside view of the left side cover illustrating the detail of engaging and cutting slide arm 38 in the dispensing position of FIG. 4. Here the case left side is again denoted by numeral 12. A tape aligning button is identified by the numeral 28, the roller is denoted by numeral 14 while the numeral 16 designates the tape clamp. Numeral 36 denotes a slide arm return spring while numeral 38 denotes the slide arm. Numeral 44 shows a slot cut into the side of the case to permit the button 10 of FIG. 2 to actuate the slide arm 38. Numeral 36*a* denotes a stop for holding one end of spring 36 stationary. Numeral 42 denotes a tape clamp engaging lobe whose operation will be more fully explained in conjunction with FIG. 7. Numeral 40 denotes a serrated cutting edge for severing the tape as applied from the roll on the roller. The arrow in the figure is to indicate that the slide arm 38 appears in its left-most position in the picture.

Referring not to FIG. 7, there is a fragmentary partial inside view of the left side cover showing detail of the engaging and cutting slide arm in a second position of FIG. 5, that is, the tape clamp engaging and tape cutting position. In the position shown, slide button 10 of FIG. 2 has now been operated so as to move slide arm 38 in its constraining slot 44 to the right-most position thus tensioning spring 36 in relation to its stop 36*a*. Tape clamp engaging lobe 42 has pushed tape clamp 16 into the position shown by the arrow and serrated cutting edge 40 has engaged the tape so as to sever it from the roll.

Referring now to FIG. 8, the detail of the slide arm 38 is shown. Numeral 46 denotes a spring notch such as may be used to retain the spring 36. Numeral 42 denotes the tape clamp engaging lobe whose function is to operate the tape clamp 16 as was explained with reference to FIG. 7 and numeral 40 denotes the serrated cutting edge whose function is to sever the applied tape from the tape remaining on the roller.

Having enumerated, named and explained the component parts of the invention, its operation will now be further explained with respect to the embodiment contemplated by the drawings of FIG. 1 through FIG. 8.

In operation, a standard roll of transparent tape 4 is placed in between case halves 12 and 13 and the cases are pushed together thus forming case 2 generally with roller 14 and serrated edge 40 aligned in their respective slots and holes. Tape is payed out normally for conventional use wherein a length of tape is first stripped off the roll before application. For the roll-on application of the invention, the tape is rolled backwards, the end grasped and pulled out enough to extend between aligning buttons 28 and advanced over and under roller 14. Slide button 10 is pushed forward with the thumb thus advancing slide arm 38 toward roller 14. Lobe 42, situated at the forward end of slide arm 38 overcomes the rockersnap spring 18 and forces the tape clamp 16 into the holding position with tooth 20 meshing with star gear 22. Tape clamp 16 now holds the tape 4 to the roller 14 ready for application of tape. Releasing slide button 10 will allow it to return to normal position under the action of spring 36. Clamp 16 is then held in place by rocker snap spring 18. The tape may now be rolled onto surfaces to be joined or held together. Tape clamp 16 will be advanced with roller 14 by the engagement of tooth 20 with star gear 22 for approximately 45° of a rotation. The tape clamp 16 is disengaged at approximately one-half roller rotation by cam 32 forcing the rocker snap spring 18 into its original position. When tooth 20 on tape clamp 16 becomes disengaged, the tape clamp 16 is returned to its normal position by the action of return spring 30. When the desired taping has been finished, the operator will advance slide button 10 toward roller 14 thus again advancing slide arm 38. Tape clamp engaging lobe 42 will now engage tape clamp 16 thus forcing rocker snap spring 18 to snap and clamp the tape to roller 14. As slide arm 38 advances further, the serrated cutting edge 40 will cut the tape. Slide arm return spring 36 will now return slide arm 38 to the normal position for the next application of the tape. In order to effect an additional application of the tape it is now only necessary to press the applicator to the surface to receive the tape and push the dispenser in the direction indicated.

Thus, there has been described a tape applicator, operable with one hand to apply adhesive tape to receiving surfaces. Great advantages and improvements in reliability flexibility, maintainability, ease of operation among other improvements have been provided through the novel advantages of the invention.

It is pointed out that although the present invention has been shown and described with reference to particular embodiment, nevertheless, various changes and modifications, obvious to one skilled in the art to which the invention pertains are deemed to lie within the purview of the invention.

What is claimed and desired to be secured by Letters Patent of the United States is:

1. A tape applicator for directly dispensing pressure sensitive adhesive tape from a roll onto a surface to receive the tape comprising:

a housing;

tape roll support means on said housing for supporting a roll of tape in a tape storage compartment;

tape roller means for pressing tape to be dispensed against a surface to receive the tape;

means for maintaining tape to be dispensed in contact with said tape roller means, said means comprising;

a tape clamp operated by means of a slide button against the forces of a tape clamp return spring and a slide arm return spring;

a tooth on said tape clamp to engage a star gear mounted to the roller;

a cam for forcing said tooth to engage said star gear;

a rocker snap spring to maintain the engagement of said tooth with said star gear until after the start of dispensing said pressure sensitive adhesive tape;

tape guide means for positioning tape to be applied;

tape cut-off means operable to cut the tape when a desired length of tape has been dispensed.

2. A tape applicator for directly dispensing pressure sensitive adhesive tape from a roll onto a surface to receive the tape comprising:

a housing;

tape roll support means on said housing for supporting a roll of tape in a tape storage compartment;

tape roller means for pressing tape to be dispensed against a surface to receive the tape;

means for maintaining tape to be dispensed in contact with said tape roller means, said means comprising;

a tape clamp operated by means of a slide button against the forces of a tape clamp return spring and a slide arm return spring;

a tooth on said tape clamp to engage a star gear mounted to the roller;

a cam for forcing said tooth to engage said star gear;

a rocker snap spring to maintain the engagement of said tooth with said star gear until after the start of dispensing said pressure sensitive adhesive tape;

tape guide means for positioning tape to be applied;

tape cut-off means operable to cut the tape when a desired length of tape has been dispensed, said means comprising;

a spring notch for accepting and keeping said slide arm return spring;

a cam for forcing the disengagement of said tooth on said tape clamp from said star gear; and a serrated cutting edge operable by said slide button for severing applied tape from the tape roll.

* * * * *